United States Patent [19]

Parker et al.

[11] 4,128,108

[45] Dec. 5, 1978

[54] MUD RETAINING VALVE

[75] Inventors: Bill B. Parker, Lafayette; Rudy Beynand, Broussard; Arthur J. Cormier, Lafayette, all of La.

[73] Assignee: American International Tool Company, Inc., Houston, Tex.

[21] Appl. No.: 789,018

[22] Filed: Apr. 20, 1977

[51] Int. Cl.[2] ..... F16K 43/00

[52] U.S. Cl. ..... 137/327; 137/493.9; 137/508

[58] Field of Search ..... 137/327, 493, 493.9, 137/508, 513.5; 166/319, 322, 325; 138/89

[56] References Cited

U.S. PATENT DOCUMENTS

| | | | |
|---|---|---|---|
| 834,855 | 10/1906 | Woodman | 137/513.5 X |
| 1,196,142 | 8/1916 | Schroeder | 137/508 X |
| 2,415,750 | 2/1947 | Melichar | 137/508 |
| 2,776,015 | 1/1957 | Bielstein | 138/89 |
| 2,841,171 | 7/1958 | Baker | 137/493 |
| 2,855,952 | 9/1958 | Tavsch | 166/332 X |
| 2,938,540 | 5/1960 | Schatzman | 137/508 |
| 2,951,500 | 9/1960 | Hunter | 137/493.9 |
| 3,294,113 | 12/1966 | Chenoweth | 137/508 |
| 3,331,385 | 7/1967 | Taylor | 137/327 |
| 3,967,680 | 7/1976 | Jeter | 166/325 X |

*Primary Examiner*—Harold W. Weakley

[57] ABSTRACT

A valve adapted for insertion in a radially enlarged portion of the kelly saver sub to retain mud in the kelly when the drill pipe is disconnected therefrom, including a tubular body with a downwardly extending closure member supported thereby, and a piston having an axial passage for the flow of drilling mud therethrough, axially movble within the body. The plug may be removed from the bore by the application of an upwardly directed tension force thereto, so that wire line tools may be run through the bore and the passage.

6 Claims, 5 Drawing Figures

MUD RETAINING VALVE

BACKGROUND OF THE INVENTION (a) Field of the Invention

This invention relates to apparatus for preventing the loss of drilling mud when the kelly is disconnected from the drill pipe.

(b) Description of the Prior Art

In the drilling of oil and gas wells, it is common practice to insert in the drilling string between the kelly and the drill pipe a valve to retain mud in the kelly when the drill string is broken. The advantages of using such a valve are well known and include saved mud cost, decreased chances of pollution, and increased safety to rig personnel.

Typical valves of the mud retaining type are illustrated in the following patents:

| Patentee | U.S. Pat. No. |
|---|---|
| Taylor | 3,331,385 |
| Garrett | 3,698,411 |
| Litchfield, et al | 3,738,436 |
| Williamson | 3,965,980 |
| Liljestrand | 3,967,679 |

All of the above listed patents include a downwardly opening spring loaded poppet type valve enclosed in a body having at least two parts. These two extra pieces in the drill string replace a single piece kelly saver sub, which functions to reduce wear on the kelly pin. The two-part body is generally longer than a standard kelly saver sub and consequently increases the length of the string which must be handled at the rig. In most offshore operating areas, it is mandatory that a lower manually operated kelly safety valve be included in the string at all times, which is another addition to the length of the string which must be handled. Thus, on offshore rigs, where the height of the derrick or mast is usually limited, it may be impossible to include mud retaining type valve with a two-part body.

An additional disadvantage inherent in mud retaining valves with two-part bodies is that the pin of the lower body member replaces the pin of the kelly saver sub and is therefore subject to tremendous wear. This wear limits the longevity of the pin and therefore the longevity of the valve. A solution to this problem has been to insert an additional short sub below the lower body member. However, this solution is not entirely satisfactory because it adds still more length to the string.

It sometimes becomes necessary to run wire line tools into the drill string to perform various downhole operations. It is therefore necessary that the mud retaining valve have means by which wire line tools may be run therethrough. In the device of certain of the prior art, these means take the form of a threaded plug screwed into the central portion of the movable poppet. To remove the plug of the apparatus, a tool is run into the string to engage a bolt headed portion of the plug and rotated to thereby unscrew the plug. In the valves of the other above cited patents, the central portion of the movable poppet includes a cap of a frangible material that may be broken out with a sinker bar.

Neither of these means for passing tools through a mud retaining valve is entirely satisfactory. The "threaded plug" device requires a special tool for engaging and unscrewing the plug. The frangible cap of the other patents is not entirely satisfactory in that occasionally portions of the cap remain unbroken leaving jagged projections which may damage or sever the wire line. Also, the broken out portions of the cap form debris which impedes drilling.

A further disadvantage of heretofore existing mud retaining valves is in the fact that none of them include means for adjusting the force with which their respective closure members are driven upwardly. The force may be insufficient to close the valve when heavy muds are used. When lighter muds are used, the force may be so excessive as to strain the mud pumps.

SUMMARY OF THE INVENTION

Briefly stated, the valve of the present invention includes a one piece tubular body adapted for insertion in a radially enlarged portion of a standard kelly saver sub. The body supports a downwardly extending closure member and contains an axially movable piston having a passage for the flow of drilling mud therethrough, and a radially outwardly extending flange which contacts the inside of the body.

The piston is urged upwardly toward the closure member by a spring disposed between the piston and the body and compressed between the flange and a ring member threadedly engaged at the lower end of the body. When the mud pumps are actuated, fluid pressure against the flange drives the piston downwardly and allows mud to flow through the passage. When the mud pumps are deactuated, the spring drives the piston upwardly so that the passage is blocked by the closure member. The position of the ring member may be changed axially to vary the compression of the spring so that the valve will remain closed when used with muds of different weights. The portion of the piston which forms a seating surface with the closure member is a replaceable member of a wear resistent material. A removable plug for running wire line tools in the bore is provided with a spearhead retrieving member which may be engage by a standard overshot to pull the plug from the closure member by the application of only upwardly directed tension force.

DESCRIPTION OF THE PREFERRED EMBODIMENT

Figure 1:
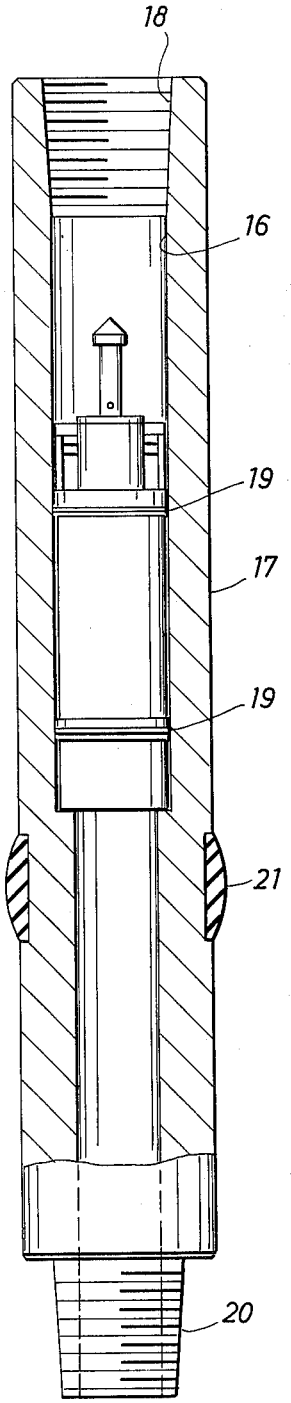
FIG. 1 is a side elevation view of the device of the preferred embodiment of the present invention inserted in a radially enlarged portion of a kelly saver sub.

Referring now to the drawings, the valve of the preferred embodiment of the invention, designated generally by the numeral 11, is illustrated in FIG. 1 disposed within a radially enlarged portion 16 of a kelly saver sub 17. Kelly saver sub 17 has a box 18 at the upper end thereof to accommodate the pin of the kelly (not shown), and a pin 20 at the lower end thereof for insertion into either the drill pipe or a lower kelly safety valve (neither shown). Kelly saver sub 17 saves wear on the kelly pin by reducing the number of times that pipes are made up to it. Kelly saver sub 17 also includes a rubber bumper 21 which serves to space the kelly from the surface casing and thereby prevents wear to both.

Valve 11 is comprised generally of a tubular body 12, a downwardly extending closure member 13 supported by body 12 and an axially movable piston 14 disposed within body 12 having an axial bore 15 therethrough. Body 12 is of unitary tubular construction, and is of a diameter approximately equal to the inside diameter of radially enlarged portion 16 of kelly saver sub 17. Body 12 is provided with a circumferential seals 19 to prevent the flow of fluid around the outside thereof.

Figure 2:
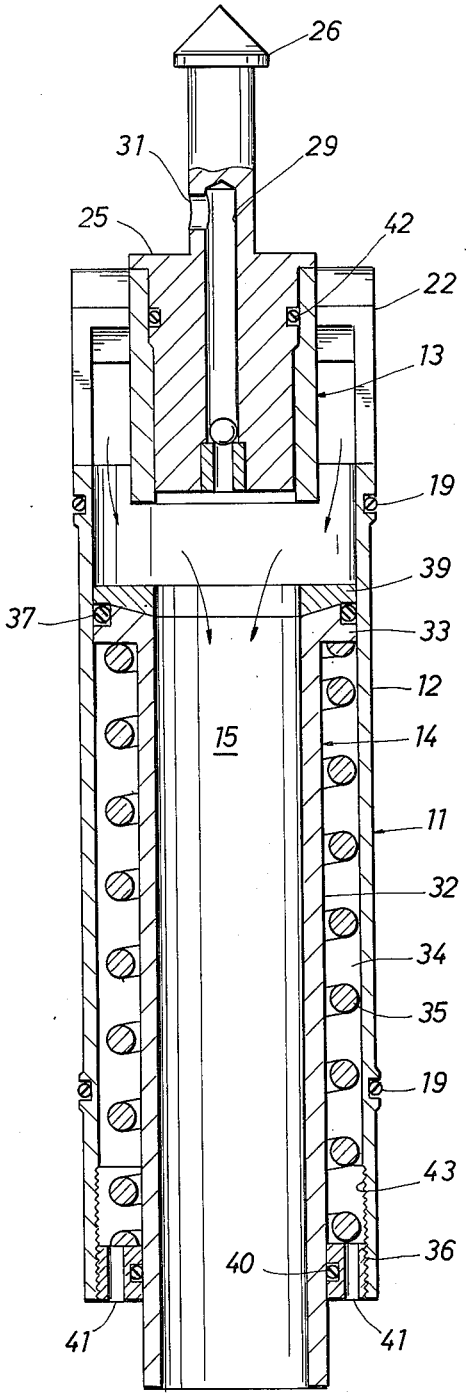
FIG. 2 is a sectional view of the open valve, with arrows showing the flow of mud therethrough.

Piston 14 includes a tubular portion 32 and a flange 33. Tubular portion 32 is of a smaller outside diameter than the inside diameter of body 12 in order to form an annular chamber 34 to accommodate compression spring 35. Compression spring 35 is compressed between flange 33 and a ring member 36 threadedly engaged at the lower end of body 12. Flange 33 extends radially outwardly into contact with the inside of body 12, and is provided with a seal 37 to prevent mud from flowing into chamber 34. Compression spring 35 serves to urge piston 14 upwardly when the mud pumps are not in operation. When the mud pumps are in operation, fluid pressure on flange 33 drives piston 14 downwardly and allows mud to flow into passage 15 as shown by the arrows in FIG. 2.

Because of the abrasive nature of drilling mud, the upper seat forming portion of flange 33 is provided with an annular wear resistent member 39. Member 39 is formed of a hard material, such as tungsten carbide, which is much less subject to erosion than is steel. Member 39, therefore, greatly increases the longevity of valve 11 and if, after some time valve 11 begins to leak because of the erosion of member 39, member 39 may be replaced.

Ring member 36 extends from the inside of body 12 to the outside of tubular portion 32 and is provided with a seal 40. The threaded portion 43 at the lower end of body 12 extends a substantial distance upwardly from the bottom of body 12 in order that ring member 36 may be screwed upwardly and downwardly to a plurality of positions. By changing the position of ring member 36, the compression of spring 35 may be varied to compensate for increased mud weights. Ring member 36 is provided with two diametrically positioned holes 41 which serve both as points at which a tool may be applied to screw ring 36 upwardly and downwardly within body 12 and as means for relieving pressure within chamber 34 as piston 14 is driven downwardly. Holes 41 also serve as means for draining any drilling mud which may accumulate in chamber 34.

Closure member 13 is supported at the upper end of body 12 by means of a pair of supports 22. Supports 22 extend upwardly from body 12 and support the outer portion 23 of closure member 13 coaxially with body 12. Outer portion 23 of closure member 13 has an axial bore 24 of a diameter substantially equal to the diameter of passage 15. A plug 25 is press-fitted into bore 24 so that bore 24 is normally closed. If, however, it becomes necessary to run wire line tools through the drill string when the kelly is below the rotary table, plug 25 may be removed from closure member 13. To remove plug 25, a standard overshot is run through the kelly to grasp the spearhead member 26 of plug 25 and apply an upward force thereto. With plug 25 so removed, wire line tools may be run through bore 24 and passage 15 and into the drill string. A set screw 41 is threaded through one support member 22 and outer portion 23 into contact with plug 25. Set screw 41 increases the tension force necessary to pull plug 25 from bore 24, and thereby decreases the possibility of plug 25 being blown out of bore 24 by a pressure kick or the like. Plug 25 is provided with a seal 42 to prevent fluid from leaking should the upper portion of plug 25 become eroded.

Figure 3:
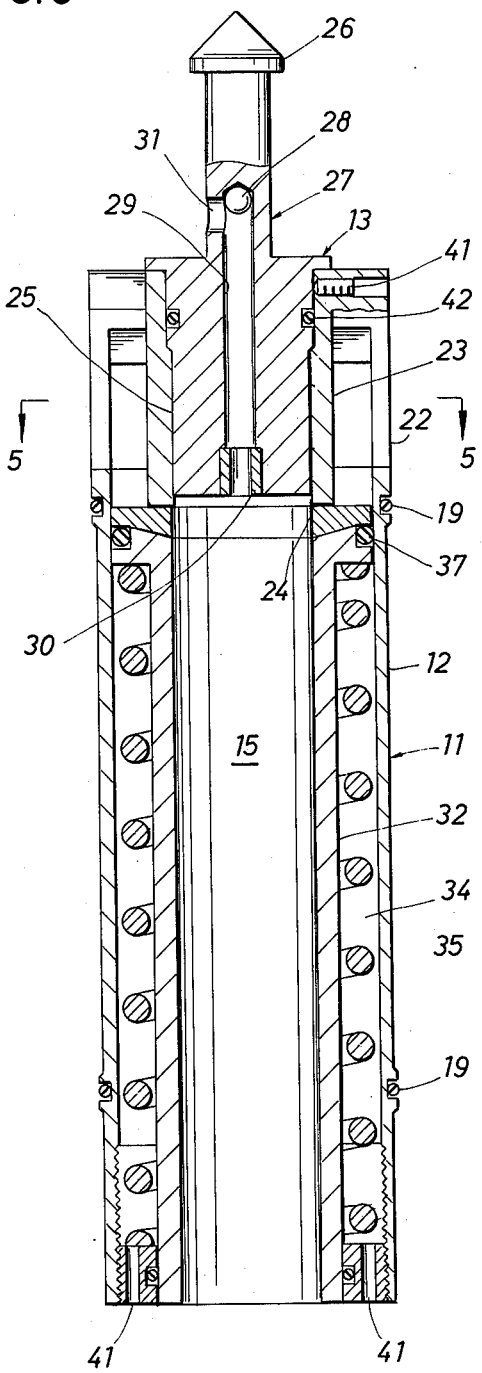
FIG. 3 is a sectional view, generally similar to that of FIG. 2, showing the valve in the closed position.
Figure 4:
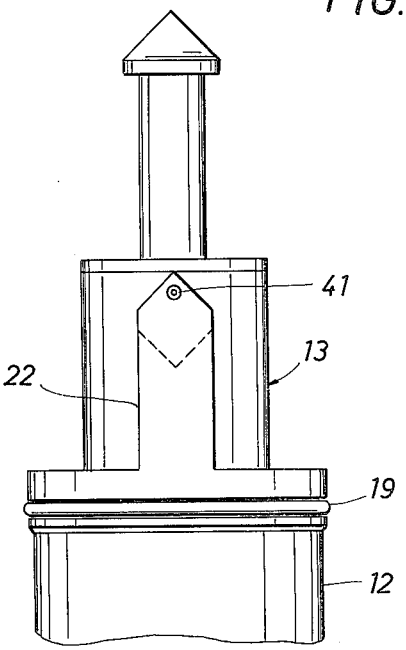
FIG. 4 is a partial elevational view showing details of the closure member support.
Figure 5:
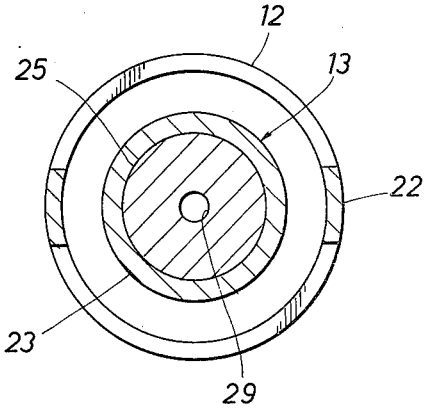
FIG. 5 is a top sectional view taken along line 5—5 of FIG. 3, showing details of construction of the apparatus.

Plug 25 is provided with a ball check valve 27 to enable the driller to detect and/or bleed off downhole pressure. Check valve 27 includes a ball 28 contained within a tube 29 and movable therein between a seat 30 and the top of tube 29 which is adjacent to a port 31. Tube 29 is normally closed when the kelly is broken from the string by ball 28 resting against seat 30. However, if the pressure of the mud inside passage 15 exceeds the pressure above valve 11, ball 28 is driven to the top of tube 29, as shown in FIG. 3, and after a brief time, pressure may be read by approprate instruments on the standpipe or at the mud pumps (neither shown).

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiment. Various changes may be made in the shape, size and arrangements of parts. For example, equivalent elements or materials materials may be substituted for those illustrated and described herein, parts may be reversed, and certain features of the invention may be utilized independently of the use of other features, all as would be apparent to one skilled in the art after having the benefit of this description of the invention.

What is claimed is:

1. In a valve for retaining mud in the kelly when the drill pipe is disconnected therefrom, the combination comprising:

a tubular body adapted to be inserted in a radially enlarged portion of a kelly saver sub;

a downwardly extending closure member supported by said body, said closure member having a bore extending axially therethrough;

an axially movable piston disposed within said body, said piston having a flange extending radially outwardly therefrom into contact with said body and a passage for the flow of drilling mud therethrough, said passage being substantially coaxial with said bore;

a plug inserted within said bore, said plug being removable from said bore by the application of an upward tension force thereto so that wire line tools may be passed through said bore and said passage;

a check valve in said plug to allow mud to flow upwardly therethrough when said passage is blocked by said closure member so that downhole pressure may be detected;

and means for urging said piston axially upward so that said passage is blocked by said closure member, thereby preventing the downward flow of mud therethrough.

2. The valve as claimed in claim 1, including:

means for varying the force with which said urging means urges said piston upwardly, to compensate for varying mud weights.

3. The valve as claimed in claim 1, wherein:

said piston includes a replaceable wear member at the position where said piston contacts said closure member when said passage is blocked by said closure member.

4. The valve as claimed in claim 1, wherein said upwardly urging means includes:

a ring member engaging the lower end of said body and extending radially inwardly into contact with said piston;

and a compression spring disposed within said body and compressed between said flange and said ring member.

5. The valve as claimed in claim 4, wherein:

said ring member is adapted for movement between a plurality of axial positions within said body to vary the compression of said compression spring to compensate for varying mud weights.

6. The valve as claimed in claim 1, including:

means for relieving pressure within the chamber between said piston and said body when said piston is driven downwardly away from said closure member.

* * * * *